US010487555B2

(12) United States Patent
Wisniewski et al.

(10) Patent No.: US 10,487,555 B2
(45) Date of Patent: Nov. 26, 2019

(54) CHECK LINK ASSEMBLY AND A VEHICLE THAT UTILIZES THE CHECK LINK ASSEMBLY

(71) Applicant: GM GLOBAL TECHNOLOGY OPERATIONS LLC, Detroit, MI (US)

(72) Inventors: Chris J. T. Wisniewski, Oshawa (CA); James C. O'Kane, Shelby Township, MI (US); Doru N. Serban, Richmond Hill (CA)

(73) Assignee: GM Global Technology Operations LLC, Detroit, MI (US)

( * ) Notice: Subject to any disclaimer, the term of this patent is extended or adjusted under 35 U.S.C. 154(b) by 139 days.

(21) Appl. No.: 15/673,709

(22) Filed: Aug. 10, 2017

(65) Prior Publication Data

US 2019/0048637 A1 Feb. 14, 2019

(51) Int. Cl.

| | |
|---|---|
| ***E05C 17/12*** | (2006.01) |
| ***E05F 5/00*** | (2017.01) |
| ***E05C 17/20*** | (2006.01) |
| ***E05C 17/00*** | (2006.01) |

(52) U.S. Cl.

CPC ..... *E05F 5/00* (2013.01); *E05C 17/003* (2013.01); *E05C 17/12* (2013.01); *E05C 17/203* (2013.01)

(58) Field of Classification Search

CPC ..... E05C 17/04; E05C 17/12; E05C 17/20; E05C 17/203; E05C 17/22; E05D 11/1071; E05D 11/1085; E05F 5/00

USPC ..... 16/82

See application file for complete search history.

(56) References Cited

U.S. PATENT DOCUMENTS

| | | | | |
|---|---|---|---|---|
| 2,893,766 | A * | 7/1959 | Meyer | E05C 17/20 285/312 |
| 2,915,779 | A * | 12/1959 | Allen | E05C 17/203 16/82 |
| 5,173,991 | A * | 12/1992 | Carswell | E05C 17/203 16/325 |
| 7,076,833 | B2 * | 7/2006 | Murayama | E05C 17/203 16/82 |
| 9,598,890 | B1 * | 3/2017 | Hooton | E05F 5/06 |
| 2004/0049882 | A1 * | 3/2004 | Schmoll | E05C 17/203 16/82 |
| 2008/0271286 | A1 * | 11/2008 | Stalhammar | E05C 17/203 16/84 |
| 2009/0070956 | A1 * | 3/2009 | Hoffmann | E05C 17/203 16/82 |
| 2012/0233813 | A1 * | 9/2012 | Settsu | E05F 5/00 16/82 |

FOREIGN PATENT DOCUMENTS

| | | | | |
|---|---|---|---|---|
| WO | WO-2008100233 | A2 * | 8/2008 | E05C 17/203 |

* cited by examiner

*Primary Examiner* — Emily M Morgan
(74) *Attorney, Agent, or Firm* — Quinn IP Law

(57) ABSTRACT

A check link assembly includes a link movable between a first position and a second position. Furthermore, a vehicle includes the check link assembly. The check link assembly also includes a braking apparatus coupled to the link. The braking apparatus includes a brake member movable between an applied position and a released position. The brake member is configured to apply a force to the link when the brake member is in the applied position. The brake member is configured to release the link when the brake member is in the released position.

20 Claims, 4 Drawing Sheets

CHECK LINK ASSEMBLY AND A VEHICLE THAT UTILIZES THE CHECK LINK ASSEMBLY

INTRODUCTION

Vehicles, such as cars, can include one or more vehicle doors such as passenger doors or rear cargo doors. The vehicle doors can move relative to a vehicle body from a closed position to an open position to allow entry of persons or objects inside the vehicle. The movement of the vehicle door can be limited by a check link assembly. When the vehicle door moves from the closed position toward the open position, the check link assembly can stop further movement of the vehicle door once the vehicle door has reached a predetermined position.

SUMMARY

The present disclosure provides a check link assembly that includes a link movable between a first position and a second position. The check link assembly also includes a braking apparatus coupled to the link. The braking apparatus includes a brake member movable between an applied position and a released position. The brake member is configured to apply a force to the link when the brake member is in the applied position which hinders movement of the braking apparatus relative to the link. The brake member is configured to release the link when the brake member is in the released position.

The present disclosure also provides a vehicle that includes a body defining an interior compartment. The vehicle also includes a door coupled to the body. The door is movable relative to the body between an open position and a closed position. The vehicle further includes a check link assembly coupled to the body and the door. The check link assembly includes a link movable between a first position and a second position. The link is configured to move toward the first position when the door moves toward the closed position. The link is configured to move toward the second position when the door moves toward in the open position. The check link assembly also includes a braking apparatus coupled to the link. The braking apparatus includes a brake member movable between an applied position and a released position. The brake member is configured to apply a force to the link when the brake member is in the applied position which dampens movement of the door to at least one of the open position and the closed position. The brake member is configured to release the link when the brake member is in the released position to allow unrestricted movement of the door to at least one of the open position and the closed position.

The detailed description and the drawings or FIGS. are supportive and descriptive of the disclosure, but the claim scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that all directional references (e.g., above, below, upward, up, downward, down, top, bottom, left, right, vertical, horizontal, etc.) are used descriptively for the FIGS. to aid the reader's understanding, and do not represent limitations (for example, to the position, orientation, or use, etc.) on the scope of the disclosure, as defined by the appended claims. The phrase "at least one of" as used herein should be construed to include the non-exclusive logical "or", i.e., A and/or B and so on depending on the number of components.

Figure 1:
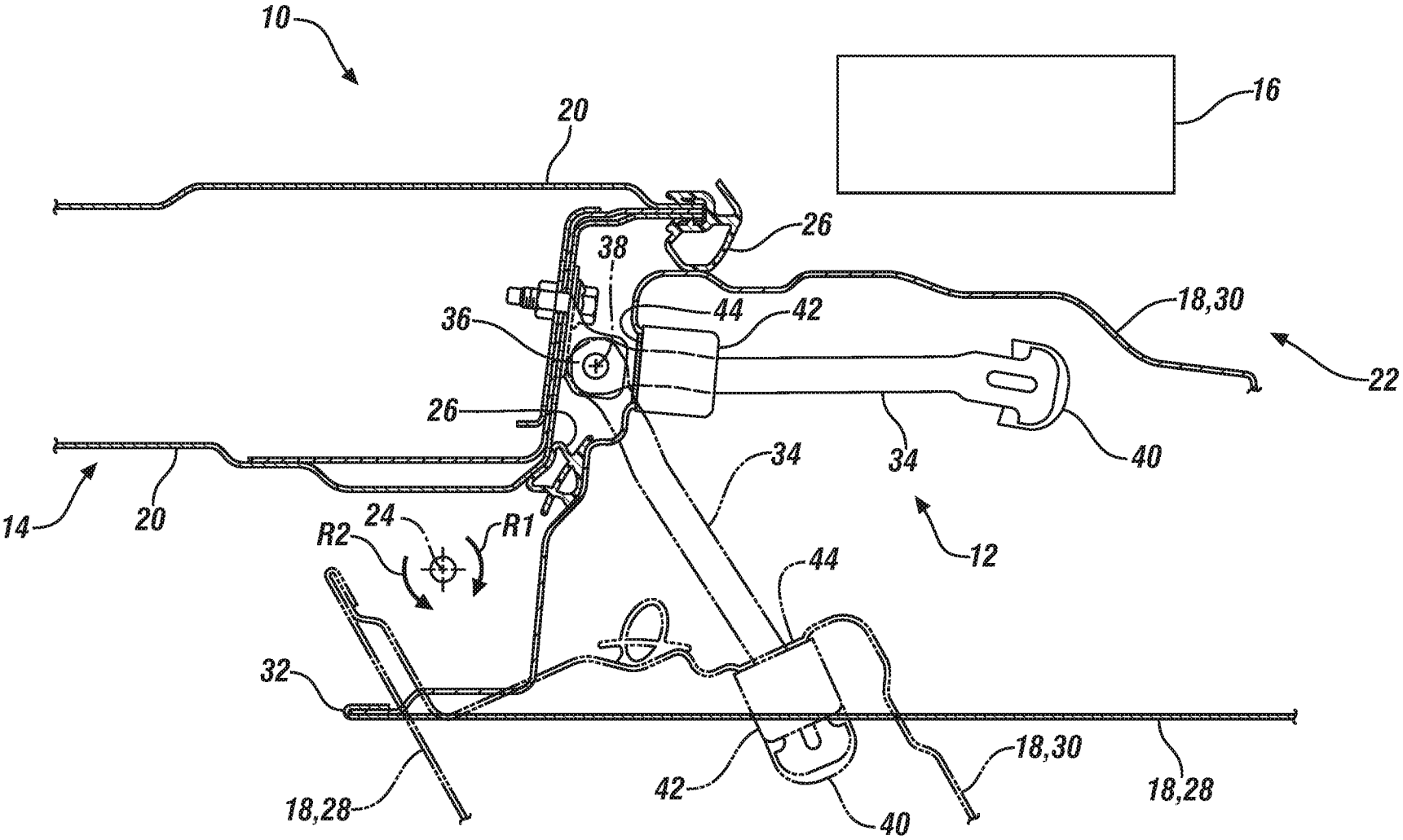
FIG. 1 is a schematic sectional top view, partly in elevation, of a portion of a vehicle including a body, a door and a check link assembly coupled between the door and the body, showing in solid lines, the door in a closed position, and showing in phantom lines, the door in an open position.

Referring to the FIGS., wherein like numerals indicate like or corresponding parts throughout the several views, a portion of a vehicle 10 and a check link assembly 12 are generally shown in FIG. 1. In certain embodiments, the check link assembly 12 can be part of the vehicle 10. Therefore, the vehicle 10 can utilize the check link assembly 12 discussed herein.

The check link assembly 12 can be utilized in a vehicle application and a non-vehicle application. For a vehicle application, the check link assembly 12 can be utilized in a car, a sports car, a truck, a boat, an off-road vehicle, etc. For the non-vehicle application, the check link assembly 12 can be utilized in a machine, equipment, etc.

Continuing with FIG. 1, the vehicle 10 can include a body 14 defining an interior compartment 16 and a door 18 coupled to the body 14. The interior compartment 16 can be a passenger compartment or a cargo compartment. The body 14 can include one or more pillars 20 to define the interior compartment 16. For example, the pillar(s) 20 can include one or more of an A-pillar, a B-pillar and a C-pillar. At least one of the pillar(s) 20 can at least partially define a door opening 22 to enter and exit the interior compartment 16. In certain embodiments, a plurality of pillars 20 defines the door opening 22.

The door 18 is movable relative to the body 14 between an open position and a closed position. Therefore, the door 18 is movable relative to the door opening 22 to open and close the door opening 22. The door 18 can allow ingress and egress of the interior compartment 16 when the door 18 is in the open position. The open position is shown in FIG. 1 in phantom lines and the closed position is shown in FIG. 1 in solid lines. It is to be appreciated that more than one door 18 can be coupled to the body 14 and movable between the open and closed positions.

Generally, the check link assembly 12 can provide controlled braking of the door 18 to the open position and/or to the closed position, which will be discussed further below. Furthermore, the check link assembly 12 can hold the door 18 in a particular position until a predetermined condition allows the door 18 to be released, which will also be discussed further below. It is to be appreciated that more than one check link assembly 12 can be utilized to provide controlled braking of the respective doors 18 to the open position and/or the closed position, and/or hold the door 18 in the particular position.

One or more couplers, such as hinges, can be coupled between the door 18 and the body 14 to allow the door 18 to rotate about hinge centerline 24 (see FIG. 1). As such, the door 18 can rotate about the hinge centerline 24 in a first rotational direction as indicated by arrow R1 (see FIG. 1) and a second rotational direction as indicated by arrow R2 (see FIG. 1). The first rotational direction indicated by arrow R1 can be opposite to the second rotational direction indicated by arrow R2. Specifically, the door 18 can rotate about the hinge centerline 24 in the second rotational direction, which is indicated by arrow R2, to move the door 18 from the open position toward the closed position. In the closed position, the door 18 closes or covers the door opening 22. Conversely, the door 18 can rotate about the hinge centerline 24 in the first rotational direction, which is indicated by arrow R1, to move the door 18 from the closed position toward the open position. In the open position, the door 18 does not close or completely cover the door opening 22, thereby allowing entry of objects or passengers into the interior compartment 16 via the door opening 22.

Continuing with FIG. 1, the vehicle 10 can further include one or more seals 26 disposed between the door 18 and a portion of the body 14 such as the pillar 20. The seals 26 can minimize fluid flow between the atmosphere outside of the vehicle 10 and the interior compartment 16 when the door 18 is in the closed position.

The door 18 can be wholly or partly made of a metallic material or sheet metal. Optionally, the door 18 can be wholly or partly made of a non-metallic material. The door 18 can include an outer door panel 28 (see FIG. 1) and an inner door panel 30 (see FIG. 1) opposing the outer door panel 28. The inner door panel 30 can be attached to the outer door panel 28 at an end portion 32 of the door 18.

The check link assembly 12 can be coupled to the body 14 and the door 18. Generally, the check link assembly 12 can limit movement of the door 18 relative to the body 14. For example, the check link assembly 12 can limit movement of the door 18 in the first rotational direction indicated by arrow R1. In other words, when the door 18 moves from the closed position toward the open position, the check link assembly 12 can stop further movement of the door 18 once the door 18 has reached fully open (see the open position in FIG. 1). Thus, even when an user continues to apply a force or load to the door 18, the check link assembly 12 counteracts the force or load applied by the user and precludes, or at least inhibits, the door 18 from moving further in the first rotational direction indicated by arrow R1 once the door 18 has reached fully open.

Continuing with FIG. 1, the check link assembly 12 includes a link 34 movable between a first position and a second position. The link 34 is configured to move toward the first position when the door 18 moves toward the closed position. Additionally, the link 34 is configured to move toward the second position when the door 18 moves toward in the open position. The first position is shown in solid lines in FIG. 1 and the second position is shown in phantom lines in FIG. 1.

The check link assembly 12 can also provide controlled braking of the link 34. Therefore, for example, as the door 18 moves from the closed position toward the open position, the check link assembly 12 can slow down movement of the link 34 toward the second position, which correspondingly slows down movement of the door 18 to the open position. As another example, as the door 18 moves from the open position toward the closed position, the check link assembly 12 can slow down movement of the link 34 toward the first position, which correspondingly slows down movement of the door 18 to the closed position. Therefore, simply stated, the check link assembly 12 can prevent the door 18 from slamming closed or swinging open too quickly.

Additionally, the check link assembly 12 can hold the link 34 in a particular position until the predetermined condition allows the door 18 to be released. Therefore, for example, when the door 18 stops in a particular position, regardless of whether the door 18 is moving toward the open position or the closed position, the check link assembly 12 can hold or maintain the door 18 in that particular position until the predetermined condition allows the door 18 to be released. The specific features of the check link assembly 12 that slow down movement of the link 34/the door 18, and/or hold the door 18 in a particular position, are discussed further below.

Continuing with FIG. 1, the link 34 can include a first link end 36 fixed to the body 14 such that the first link end 36 defines a pivot point 38 that the link 34 rotates about when moving between the first and second positions. The link 34 can also include a second link end 40 spaced from the first link end 36. As shown in FIG. 1, the link 34 is disposed through part of the door 18, and as the door 18 moves between the open and closed position, the door 18 moves relative to the link 34 between the first and second link ends 36, 40. Therefore, for example, when the door 18 is in the closed position, part of the door 18 is disposed closer to the first link end 36 than the second link end 40. Furthermore, when the door 18 is in the open position, that same part of the door 18 is disposed closer to the second link end 40 than the first link end 36. The second link end 40 can act as a stop to preclude, or at least inhibit, the door 18 from moving further in the first rotational direction indicated by arrow R1 once the door 18 has reached fully open (see phantom lines in FIG. 1). The link 34 can optionally be configured the same for all of the embodiments herein.

Continuing with FIG. 1, the check link assembly 12 also includes a braking apparatus 42 coupled to the link 34. FIG. 1 illustrates the braking apparatus 42 schematically because the braking apparatus 42 can be various configurations, some of which are discussed below. Generally, the braking apparatus 42 is supported by the door 18. In certain embodiments, a bracket 44 can be fixed to the door 18 and coupled to the braking apparatus 42 to support the braking apparatus 42 relative to the link 34. For example, the bracket 44 can be fixed to the inner door panel 30.

Referring to FIGS. 2-5, the braking apparatus 42 includes a brake member 46 movable between an applied position and a released position. The arrows 48 illustrated in FIGS. 4 and 5, indicate the direction of the applied position, and the released position is in the opposite direction from the arrows 48. The brake member 46 is configured to apply a force to the link 34 when the brake member 46 is in the applied position which hinders movement of the braking apparatus 42 relative to the link 34 (see the direction of arrows 48 in FIGS. 4 and 5). In certain embodiments, the brake member 46 can move toward the link 34 as the link 34 moves to at least one of the first position and the second position to apply the force to the link 34 when in the applied position. For example, the brake member 46 can apply the force to the link 34 when the brake member 46 is in the applied position which dampens movement of the door 18 to at least one of the open position and the closed position. As such, the brake member 46 can move to the applied position when the link 34 moves to the first position and/or the second position, and thus, can dampen movement of the door 18 to the open position and/or the closed position.

In other embodiments, the brake member 46 can move toward the link 34 when the link 34 is stationary to apply the force to the link 34 when in the applied position. In this example, the brake member 46 can move toward the link 34 to hold or maintain the door 18 in the particular position until the predetermined condition allows the door 18 to be released. Non-limiting examples of the predetermined condition can include time, a force applied to the door 18 to move the door 18, overcoming a braking force applied to the link 34 via the brake member 46, etc.

Once the force applied to the link 34 by the brake member 46 is removed, the link 34 is released to allow unrestricted movement of the door 18 to at least one of the open position and the closed position. Therefore, the brake member 46 is configured to release the link 34 when the brake member 46 is in the released position. In certain embodiments, the brake member 46 is configured to release the link 34 as the link 34 moves to at least one of the first position (the opposite direction of arrows 48 in FIGS. 4 and 5) and the second position when in the released position. Therefore, for example, the brake member 46 can release the link 34 when the brake member 46 is in the released position to allow unrestricted movement of the door 18 to at least one of the open position and the closed position. As such, the brake member 46 can move to the released position, away from the link 34, when the link 34 moves to the first position and/or the second position, and thus, allows unrestricted movement of the door 18 to the open position and/or the closed position.

In other embodiments, the brake member 46 can move to the released position when the link 34, and thus the door 18, is stationary. Therefore, in this example, the brake member 46 can release the link 34 before or after any movement of the link 34, and thus door 18, occurs.

FIGS. 2-5 illustrate a couple different examples of suitable braking apparatuses 42. The braking apparatus 42 of FIGS. 2-5 are each generally supported by the door 18. For each of these embodiments, the braking apparatus 42 includes a housing 50 defining an aperture 52. The housing 50 is movable relative to the link 34 during movement of the link 34 between the first and second positions. Therefore, the housing 50 and the link 34 are movable relative to each other. For each of these embodiments, the housing 50 is disposed closer to the first link end 36 than the second link end 40 when the door 18 is in the closed position. Furthermore, for these embodiments, the housing 50 is disposed closer to the second link end 40 than the first link end 36 when the door 18 is in the open position. In certain embodiments, the housing 50 engages the second link end 40 when the door 18 is in the open position which precludes, or at least inhibits, the door 18 from moving further in the first rotational direction indicated by arrow R1.

The link 34 can be disposed through the aperture 52 of the housing 50. As such, the housing 50 can be disposed between the first and second link ends 36, 40. Furthermore, as best shown in FIGS. 3 and 5, the brake member 46 can be disposed inside the aperture 52 of the housing 50. In certain embodiments, more than one brake member 46 can be utilized. Therefore, for example, as shown in FIGS. 2-5, the brake member 46 can be further defined as a first brake member 46 and the braking apparatus 42 can further include a second brake member 54. The link 34 can be disposed between the first and second brake members 46, 54. Furthermore, the first and second brake members 46, 54 can be disposed inside the aperture 52 of the housing 50. Generally, the housing 50 and the first and second brake members 46, 54 can be disposed between the first and second link ends 36, 40 of the link 34. For the embodiment of FIGS. 2-4, optionally, both of the brake members 46, 54 are movable, and for the embodiment of FIG. 5, optionally, one of the brake members 46, 54 is movable. Therefore, for example, as illustrated in FIG. 5, the first brake member 46 is movable relative to the housing 50 and/or the link 34, but the second brake member 54 is fixed to the housing 50, i.e., is not movable relative to the housing 50 and/or the link 34.

Figure 2:
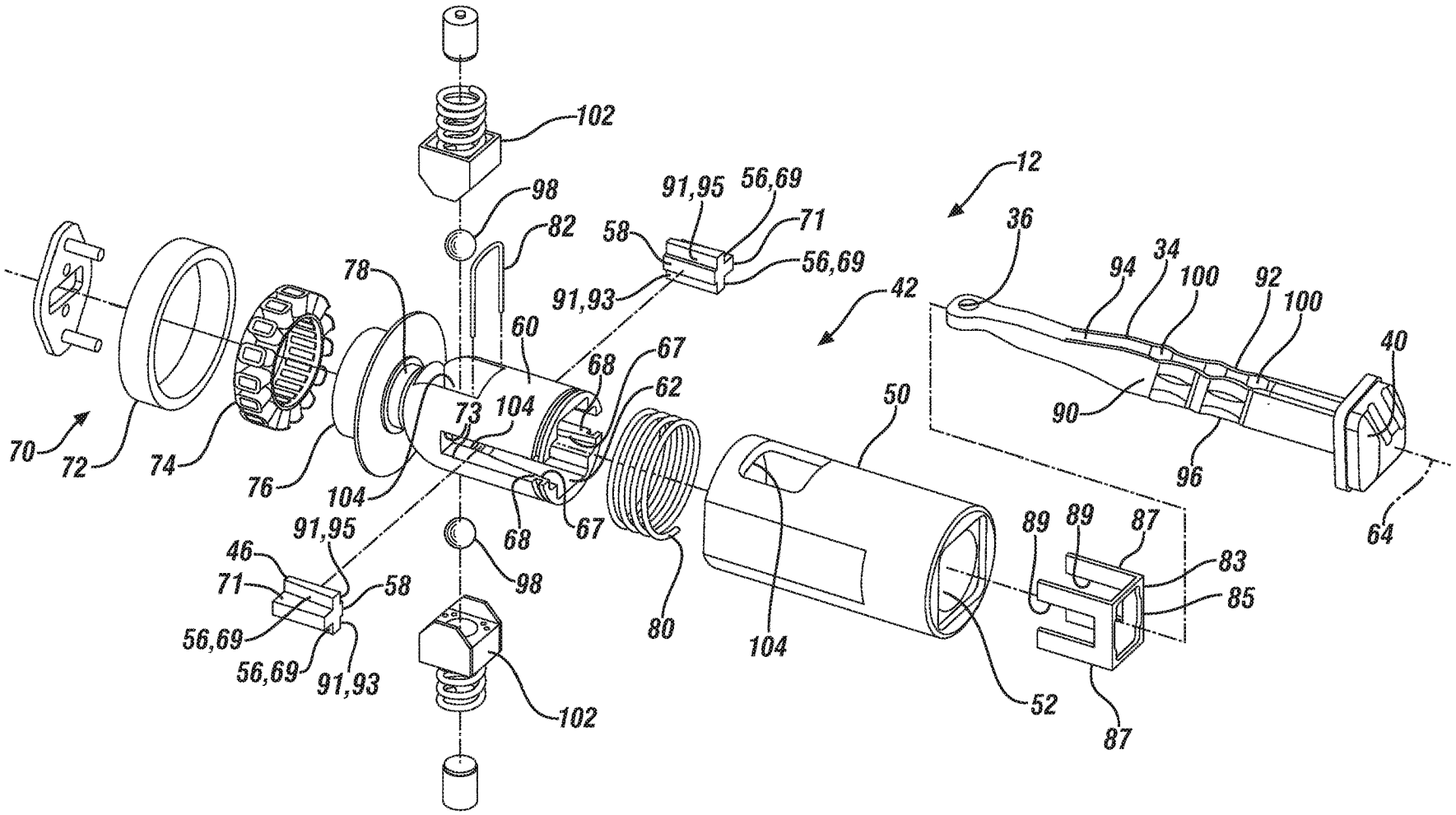
FIG. 2 is a schematic exploded perspective view of a braking apparatus of one configuration.
Figure 3:
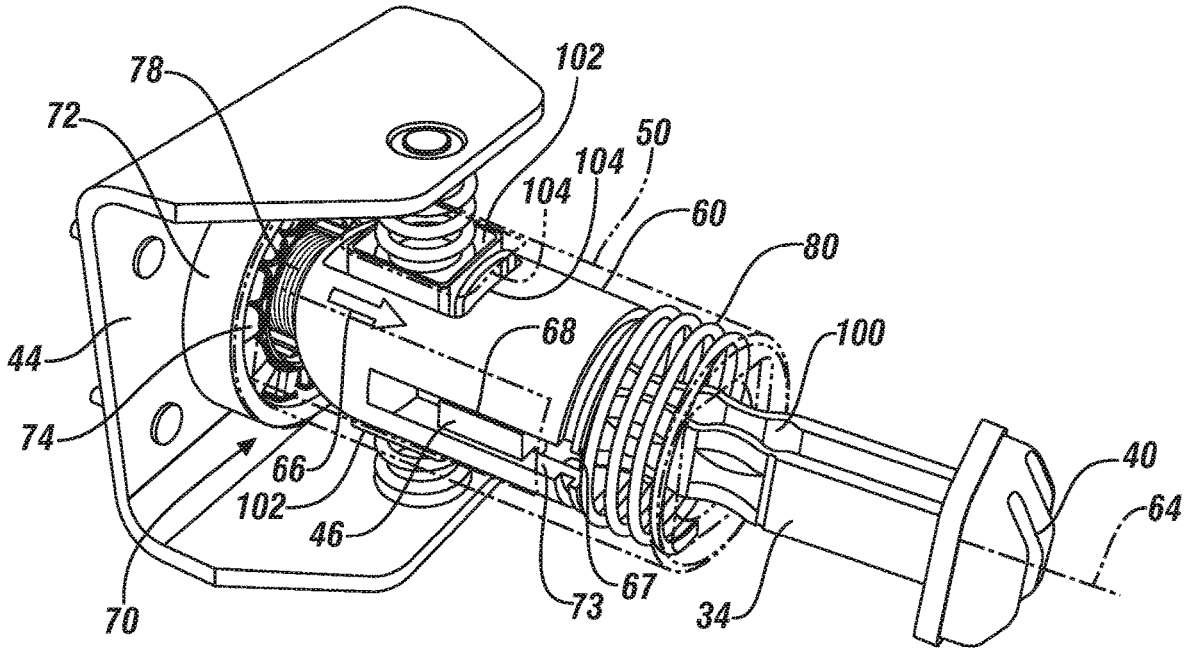
FIG. 3 is a schematic perspective view of the braking apparatus of FIG. 2 with a housing shown in phantom lines and a rotor removed.

Referring to FIGS. 2 and 5, the brake member 46 can include a pad surface 58 that faces the link 34. The pad surface 58 engages the link 34 when the brake member 46 is in the applied position, which creates friction between the pad surface 58 and the link 34 to brake or slow down movement of the link 34 and/or prevent movement of the link 34.

Figure 4:
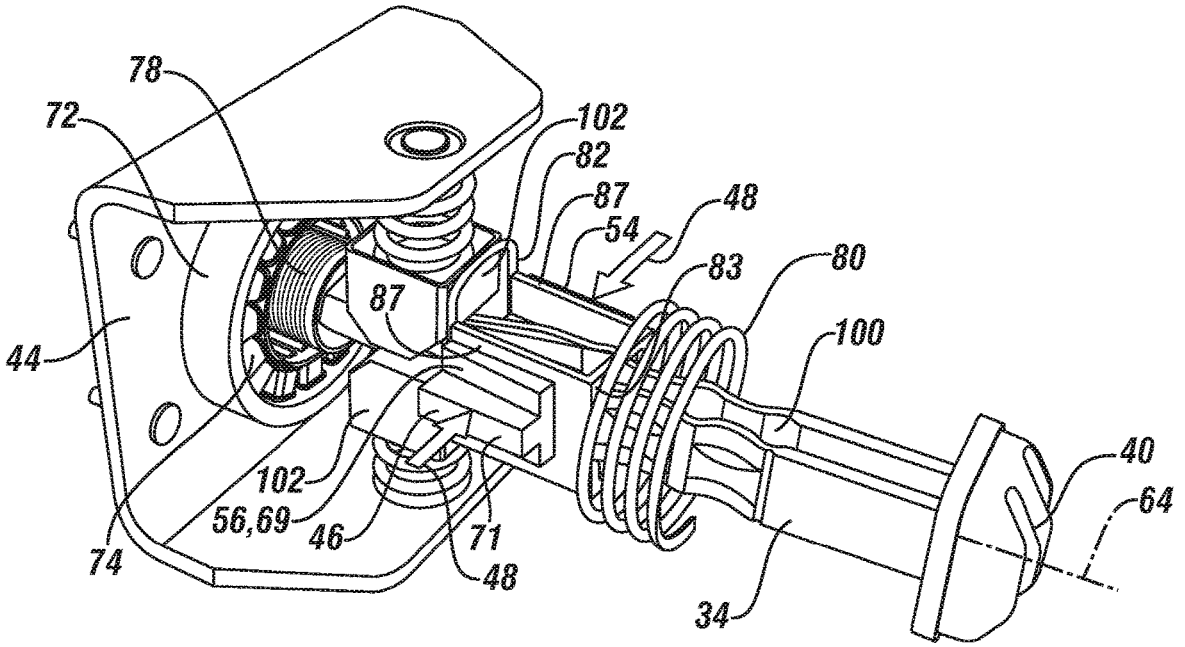
FIG. 4 is a schematic perspective view of the braking apparatus of FIGS. 2 and 3 with a sleeve, a housing and a rotor removed.
Figure 5:
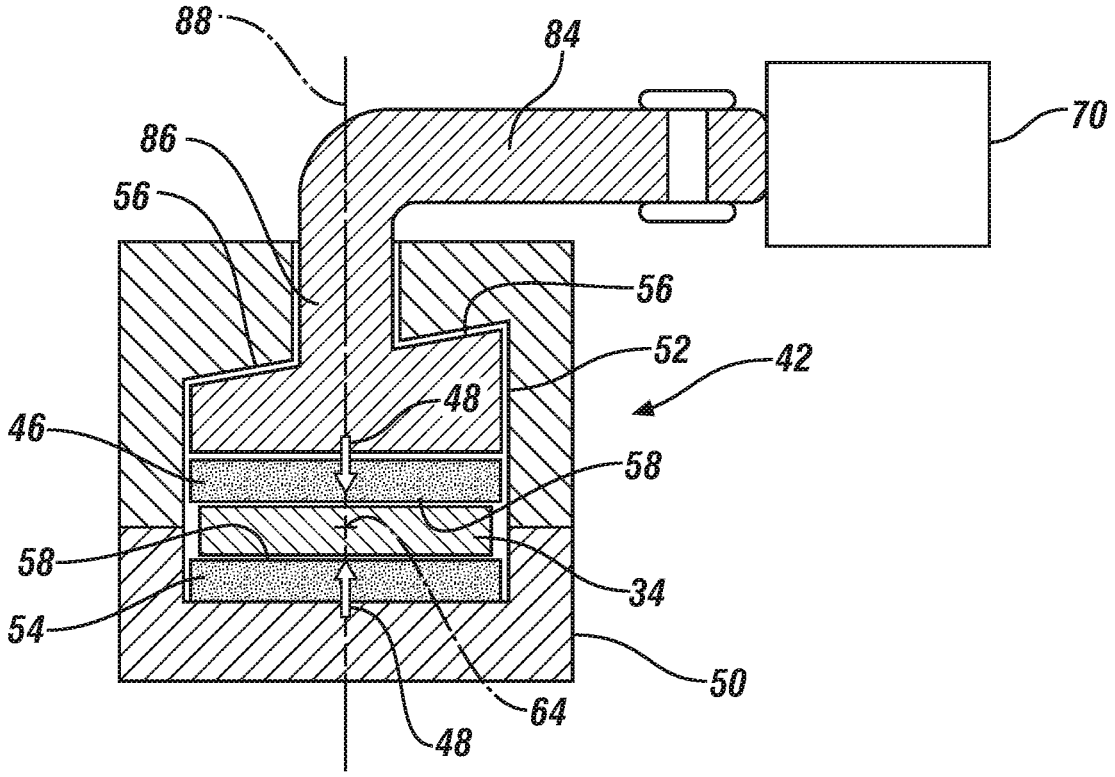
FIG. 5 is a schematic cross-sectional view of a braking apparatus of another configuration.

Turning to FIGS. 2-4, the braking apparatus 42 can include a sleeve 60 defining a hole 62 along a central axis 64. Generally, the link 34 can be disposed through the hole 62. Furthermore, in this embodiment, the housing 50 surrounds the sleeve 60. Therefore, the sleeve 60 is disposed in the aperture 52 of the housing 50.

The sleeve 60 can be movable axial relative to the central axis 64 between an initial position and a final position. Movement of the sleeve 60 to one of the initial position and the final position causes the brake member 46 to move to one of the applied position and the released position. When utilizing a plurality of brake members 46, 54, movement of the sleeve 60 to one of the initial position and the final position causes the first and second brake members 46, 54 to move to one of the applied position and the released position. Arrow 66 illustrated in FIG. 3 indicates the direction of movement of the sleeve 60 to the final position, and the initial position is in the opposite direction from arrow 66. Therefore, for example, when the sleeve 60 moves from the initial position to the final position, the first and/or second brake members 46, 54 move to the applied position, and when the sleeve 60 moves from the final position back to the initial position, the first and/or second brake members 46, 54 move to the released position.

Furthermore, as best shown in FIG. 2, the sleeve 60 can define a slot 68, in which the brake member 46 is at least partially disposed inside the slot 68. When utilizing a plurality of brake members 46, 54, the sleeve 60 can define a plurality of slots 68, with the first brake member 46 at least partially disposed inside one of the slots 68 and the second brake member 54 at least partially disposed inside another one of the slots 68.

As best shown in FIG. 2, the sleeve 60 can include an inner wall 67 and the brake member 46 can include an outer wall 69. The inner wall 67 of the sleeve 60 and the outer wall 69 of the brake member 46 engage each other. At least one of the inner wall 67 and the outer wall 69 can include a tapered surface 56 extending axially relative to the central axis 64. The tapered surface 56 causes movement of the brake member 46 transverse to the central axis 64 to one of the applied position and the released position. In certain embodiments, the tapered surface 56 can be disposed along the outer wall 69 of the brake member 46, but not the inner wall 67 of the sleeve 60. In other embodiments, the tapered surface 56 can be disposed along the inner wall 67 of the sleeve 60, but not the outer wall 69 of the brake member 46. In yet other embodiments, both the inner wall 67 of the sleeve 60 and the outer wall 69 of the brake member 46 can include the tapered surface 56. In certain embodiments, the tapered surface 56 of the sleeve 60 increases in thickness in a first direction and the tapered surface 56 of the brake member 46 increases in thickness in a second direction opposite the first direction. For example, the second direction of the tapered surface 56 of the brake member 46 can be in the same direction as arrow 66 in FIG. 3, and therefore, the first direction of the tapered surface 56 of the sleeve 60 is in the opposite direction from arrow 66 in FIG. 3.

It is to be appreciated that more than one tapered surface 56 can be utilized. Furthermore, when utilizing a plurality of brake members 46, 54, each of the brake members 46, 54 can optionally include one or more tapered surfaces 56, and the inner wall 67 of the sleeve 60 can include more than one tapered surface 56. The tapered surface(s) 56 can be any suitable configuration, and non-limiting examples can include a wedge, a slope, an arcuate configuration, etc., and combinations thereof. In certain embodiments, the pad surface 58 of the brake member 46 faces in an opposite direction from the tapered surface 56 of the brake member 46.

The brake member 46 can include a guide 71 protruding from the outer wall 69 which abuts at least one surface 73 of the sleeve 60 inside the slot 68. In certain embodiments, the guide 71 can abut a plurality of surfaces 73 of the sleeve 60 inside the slot 68. The guide 71 can restrict transverse or perpendicular movement of the brake member 46 relative to the central axis 64. It is to be appreciated that the brake member 46 can utilize a plurality of guides 71. When utilizing a plurality of brake members 46, 54, each of the brake members 46, 54 can optionally include one or more guides 71.

Referring to FIGS. 2-5, the braking apparatus 42 can include an actuator 70. Generally, the actuator 70 is operable to cause the brake member 46 to move to at least one of the applied position and the released position. For the embodiment of FIGS. 2-4, the actuator 70 is operable to move the sleeve 60 to one of the initial position and the final position which causes the brake member 46 to move to one of the applied position and the released position. Therefore, the actuator 70 can indirectly cause the brake member 46 to move.

In certain embodiments, the actuator 70 can be operable to cause the first and/or second brake members 46, 54 to move to at least one of the applied position and the released position. Therefore, as one example, operation of the actuator 70 can move the sleeve 60 to the final position, which causes one or more of the brake member(s) 46, 54 to move to the applied position. As another example, operation of the actuator 70 can move the sleeve 60 to the initial position, which causes one or more of the brake member(s) 46, 54 to move to the released position. As yet another example, operation of the actuator 70 can move the sleeve 60 to both the initial and final positions, which causes one or more of the brake member(s) 46, 54 to move to the released and applied positions.

In certain embodiments, the actuator 70 is fixed to the door 18 and operable to cause the brake member 46 to move to at least one of the applied position and the released position. Specifically, in certain embodiments, the actuator 70 can be fixed to the bracket 44.

The actuator 70 can be any suitable configuration, and non-limiting examples can include a solenoid, a motor, etc. Referring to FIGS. 2-4, the actuator 70 can include a magnet 72, coil windings 74, a rotor 76 and a movable member 78 cooperating with each other to selectively move the sleeve 60. The coil windings 74 can surround part of the rotor 76 and the magnet 72 can surround the coil windings 74. When the magnet 72/the coil windings 74 are energized in a particular manner, the rotor 76 will rotate which causes the movable member 78 to move. Movement of the movable member 78 causes the sleeve 60 to move to one of the initial and final positions. In certain embodiments, the movable member 78 is a push rod. The movable member 78 can be threaded to the rotor 76 such that rotation of the rotor 76 causes the movable member 78 to unscrew or screw into the rotor 76. Therefore, the movable member 78 can be configured to rotate and move axially relative to the central axis 64.

A controller can be in communication with the actuator 70 to control the actuator 70 to apply the desired amount of braking to the link 34 to slow the opening and/or the closing of the door 18, and/or hold or maintain the door 18 in a particular position until the predetermined condition allows the door 18 to be released. Therefore, the controller can communicate with the actuator 70 to activate the actuator 70 to cause movement of the sleeve 60, which moves one or more of the brake member(s) 46, 54 to at least one of the applied and released positions. The controller can include a processor and a memory on which is recorded instructions for communicating with the actuator 70, etc. The controller is configured to execute the instructions from the memory, via the processor. For example, the controller can be a host machine or distributed system, e.g., a computer such as a digital computer or microcomputer, and/or as a proportional-integral-derivative (PID) controller device having the processor, and, as the memory, tangible, non-transitory computer-readable memory such as read-only memory (ROM) or flash memory. The controller can also have random access memory (RAM), electrically erasable programmable read-only memory (EEPROM), a high-speed clock, analog-to-digital (A/D) and/or digital-to-analog (D/A) circuitry, and any required input/output circuitry and associated devices, as well as any required signal conditioning and/or signal buffering circuitry. Therefore, the controller can include all software, hardware, memory, algorithms, connections, sensors, etc., necessary to communicate with the actuator 70, etc. It is to be appreciated that the controller can also include any device capable of analyzing data from various sensors, comparing data, making the necessary decisions required to communicate with the actuator 70, etc.

Referring to FIGS. 2-4, the braking apparatus 42 can optionally include a first return to move the sleeve 60 to the other one of the initial position and the final position. In one embodiment, the first return includes a first biasing member 80 that returns the sleeve 60 to the other one of the initial position and the final position. The first biasing member 80 is spaced from the link 34 such that the first biasing member 80 and the link 34 do not interfere with each other. In certain embodiments, the first biasing member 80 can continuously bias the sleeve 60 in the opposite direction of arrow 66. As such, the actuator 70 can operate to move the sleeve 60 to the final position which causes the brake member 46 to move to the applied position. Therefore, in certain embodiments, the first biasing member 80 returns the sleeve 60 to the initial position which allows the brake member 46 to return to the released position. The first biasing member 80 can be any suitable configuration, and non-limiting examples can include a coil spring, a lever, a Belleville washer, a leaf-spring, etc.

As best shown in FIGS. 2 and 4, the braking apparatus 42 can include a stop 82 engaging an end of the brake member 46 to minimize axial movement of the brake member 46 relative to the central axis 64 independently of the sleeve 60. The stop 82 is spaced from the link 34 such that the stop 82 and the link 34 do not interfere with each other. If utilizing a plurality of brake members 46, 54, the stop 82 can be configured to minimize axial movement of all of the brake members 46, 54 relative to the central axis 64. It is to be appreciated that more than one stop 82 can be utilized.

The braking apparatus 42 can also include a second return to move the brake member 46 to the other one of the applied position and the released position. In one embodiment, the second return includes a second biasing member 83 that returns the brake member 46 to the other one of the applied position and the released position. The second biasing member 83 engages a portion of the brake member 46 to return the brake member 46 to one of the applied position and the released position. In one embodiment, the second biasing member 83 continuously biases the brake member 46 to the released position. When utilizing a plurality of brake members 46, 54, each of the brake members 46, 54 can include the second return, such as the second biasing member 83. Therefore, one second biasing member 83 can move both of the first and second brake members 46, 54.

For the embodiment of FIGS. 2-4, the housing 50 can contain the sleeve 60, the first biasing member 80, the second biasing member 83, the brake member 46 and at least part of the stop 82. Furthermore, in certain embodiments, the housing 50, the sleeve 60, the brake member 46, the first biasing member 80, the stop 82, the second biasing member 83 and the actuator 70 can be disposed between the first and second link ends 36, 40 of the link 34. Additionally, when utilizing a plurality of brake members 46, 54, the housing 50 can contain the sleeve 60, the first biasing member 80, the second biasing member 83, the first and second brake members 46, 54 and at least part of the stop 82.

The second biasing member 83 can include a hole 85 along the central axis 64. The link 34 can be disposed through the hole 85. Additionally, the second biasing member 83 can include at least one finger 87 defining a slit 89. The slit 89 receives part of the brake member 46.

In certain embodiments, the finger 87 is further defined as a plurality of fingers 87 spaced from each other, and each of the fingers 87 define a respective slit 89. In this embodiment, one of the slits 89 receives part of the first brake member 46 and another one of the slits 89 receives part of the second brake member 54.

The first and second brake members 46, 54 can include an inner wall 91 facing the link 34. The outer wall 69 of the respective brake members 46, 54 can oppose the inner wall 91 of the respective brake members 46, 54. In certain embodiments, the pad surface 58 of each of the brake members 46, 54 protrudes outwardly from the respective inner wall 91 to present a first recessed portion 93 and a second recessed portion 95. One finger 87 can engage the inner wall 91 of the first brake member 46 to continuously bias the first brake member 46 away from the link 34, and therefore, toward the released position. Another finger 87 can engage the inner wall 91 of the second brake member 54 to continuously bias the second brake member 54 away from the link 34, and therefore, toward the released position. The pad surface 58 of the first brake member 46 can protrude beyond the respective slit 89 such that the pad surface 58 can directly engage the link 34 when the first brake member 46 is in the applied position. Furthermore, the pad surface 58 of the second brake member 54 can protrude beyond the respective slit 89 such that the pad surface 58 can directly engage the link 34 when the second brake member 54 is in the applied position.

Turning to FIG. 5, as discussed above, the housing 50 can define the aperture 52, and the brake member 46 can be disposed inside the aperture 52. The link 34 can be disposed through the aperture 52. Generally, the housing 50 and the first and second brake members 46, 54 can be disposed between the first and second link ends 36, 40 of the link 34. The housing 50 of FIG. 5 can be configured differently than the housing 50 of FIGS. 2-4.

Continuing with FIG. 5, the braking apparatus 42 can also include an arm 84 coupled to the actuator 70. The arm 84 can include a distal end 86 disposed inside the aperture 52 of the housing 50. The actuator 70 can be coupled to the arm 84 and operable to rotate the arm 84 about a rotation axis 88. Part of the braking apparatus 42 can include the tapered surface 56. In certain embodiments, the tapered surface 56 can be disposed along at least one of the housing 50 and the arm 84. Therefore, for example, the tapered surface 56 can be disposed along the arm 84 or the tapered surface 56 can be disposed along the housing 50. As another example, the tapered surface 56 can be disposed along the housing 50 and the arm 84.

In certain embodiments, the tapered surface 56 is disposed along the housing 50 and the tapered surface 56 faces the link 34. In other embodiments, the tapered surface 56 is disposed along the distal end 86 of the arm 84. When the tapered surface 56 is disposed along the arm 84, rotation of the arm 84 causes the tapered surface 56 to rotate which moves the brake member 46 to one of the applied position and the released position. The actuator 70 is operable to rotate the arm 84 in one direction about the rotation axis 88 to move at least one of the brake member(s) 46, 54 to the applied position, and the actuator 70 is operable to rotate the arm 84 in the opposite direction about the rotation axis 88 to allow at least one of the brake member(s) 46, 54 to move to the released position. Again, the actuator 70 can be fixed to the door 18 and can be any suitable configuration including the examples discussed above.

Turning to the configuration of the link 34, as best shown in FIG. 2, the link 34 can include a first outer surface 90 and a second outer surface 92 opposing each other. Additionally, the link 34 can include a third outer surface 94 and a fourth outer surface 96 opposing each other. The third and fourth outer surfaces 94, 96 are each disposed adjacent to the first and second outer surfaces 90, 92. The brake member 46 contacts at least one of the first and second outer surfaces 90, 92 when in the applied position. More specifically, the pad surface 58 contacts at least one of the first and second outer surfaces 90, 92 when in the applied position. In certain embodiments, when utilizing the first and second brake members 46, 54, the first brake member 46 contacts the first outer surface 90 when in the applied position and the second brake member 54 contacts the second outer surface 92 when in the applied position. More specifically, the pad surface 58 of the first brake member 46 contacts the first outer surface 90 when in the applied position and the pad surface 58 of the second brake member 54 contacts the second outer surface 92 when in the applied position.

Continuing with FIG. 2, the check link assembly 12 can include a detent member 98 facing one of the third and fourth outer surfaces 94, 96. At least one of the third and fourth outer surfaces 94, 96 can define a plurality of grooves 100 spaced from each other. The detent member 98 moves from one of the grooves 100 to the next one of the grooves 100 in response to movement of the link 34 between the first and second positions. The detent member 98 and the grooves 100 cooperate to control movement of the door 18 to the open position and the closed position. For example, when movement of the door 18 stops such that the detent member 98 rests in one of the grooves 100, the detent member 98 and the groove 100 will assist in holding the door 18 in that particular position.

Continuing with FIG. 2, for this configuration of the braking apparatus 42, the check link assembly 12 can include a caliper 102 that supports the detent member 98. In certain embodiments, a plurality of calipers 102 and a plurality of detent members 98 can be utilized, as shown in FIG. 2. The caliper(s) 102 can be continuously biased toward the link 34 such that the detent member(s) 98 remain in contact with the link 34 during movement of the link 34. For the embodiment of FIG. 2, the housing 50 and the sleeve 60 can each define openings 104 that the respective caliper 102 is disposed through. Additionally, the stop 82 can extend through the opening 104 of the housing 50 and the opening 104 of the sleeve 60. As best shown in FIG. 3, the stop 82 can be partially disposed outside of the sleeve 60 and fixed to the housing 50. It is to be appreciated that the openings 104 of the sleeve 60 is large enough to allow movement of the sleeve 60 along the central axis 64 without interfering with the caliper 102 and the stop 82.

While the best modes and other embodiments for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

What is claimed is:

1. A check link assembly comprising:

a link movable between a first position and a second position;

a braking apparatus coupled to the link, and the braking apparatus includes a brake member movable between an applied position and a released position;

wherein the brake member is configured to apply a force to the link when the brake member is in the applied position which hinders movement of the braking apparatus relative to the link, and the brake member is configured to release the link when the brake member in the released position; and wherein the braking apparatus includes a sleeve that surrounds the link and a housing that contains the sleeve;

wherein:

the sleeve defines a hole along a central axis, with the link disposed through the hole;

the sleeve is movable axial relative to the central axis between an initial position and a final position;

movement of the sleeve to one of the initial position and the final position causes the brake member to move to one of the applied position and the released position;

the braking apparatus includes an actuator operable to move the sleeve to one of the initial position and the final position which causes the brake member to move to one of the applied position and the released position;

the braking apparatus includes a first biasing member that returns the sleeve to the other one of the initial position and the final position; and the braking apparatus includes a stop engaging an end of the brake member to minimize axial movement of the brake member relative to the central axis independently of the sleeve and a second biasing member engaging a portion of the brake member to return the brake member to one of the applied position and the released position.

2. The assembly as set forth in claim 1 wherein:

the sleeve includes an inner wall and the brake member includes an outer wall;

the inner wall of the sleeve and the outer wall of the brake member engage each other; and at least one of the inner wall and the outer wall include a tapered surface extending axially relative to the central axis.

3. The assembly as set forth in claim 2 wherein both the inner wall and the outer wall include the tapered surface, and wherein the tapered surface of the sleeve increases in thickness in a first direction and the tapered surface of the brake member increases in thickness in a second direction opposite the first direction.

4. The assembly as set forth in claim 1 wherein the brake member is further defined as a first brake member and the braking apparatus includes a second brake member, with the link disposed between the first and second brake members, and wherein movement of the sleeve to one of the initial position and the final position causes the first and second brake members to move to one of the applied position and the released position.

5. The assembly as set forth in claim 1 wherein:

the housing defines an aperture along the central axis;

the link is disposed through the aperture; and the housing also contains the first biasing member, the second biasing member, the brake member and at least part of the stop.

6. The assembly as set forth in claim 5 wherein the link includes a first link end and a second link end spaced from each other relative to the central axis, and wherein the housing, the sleeve, the brake member, the first biasing member, the stop, the second biasing member and the actuator are disposed between the first and second link ends.

7. The assembly as set forth in claim 1 wherein:

the link includes a first outer surface and a second outer surface opposing each other;

the link includes a third outer surface and a fourth outer surface opposing each other, and the third and fourth outer surfaces are each disposed adjacent to the first and second outer surfaces; and the brake member contacts at least one of the first and second outer surfaces when in the applied position.

8. The assembly as set forth in claim 7 wherein the brake member is further defined as a first brake member and the braking apparatus includes a second brake member, and wherein the first brake member contacts the first outer surface when in the applied position and the second brake member contacts the second outer surface when in the applied position.

9. The assembly as set forth in claim 8:

further including a detent member facing one of the third and fourth outer surfaces;

wherein at least one of the third and fourth outer surfaces define a plurality of grooves spaced from each other; and wherein the detent member moves from one of the grooves to the next one of the grooves in response to movement of the link between the first and second positions.

10. A vehicle comprising:

a body defining an interior compartment;

a door coupled to the body and movable relative to the body between an open position and a closed position; and a check link assembly coupled to the body and the door, and the check link assembly including:

a link movable between a first position and a second position;

wherein the link is configured to move toward the first position when the door moves toward the closed position, and the link is configured to move toward the second position when the door moves toward the open position;

a braking apparatus coupled to the link, and the braking apparatus includes a brake member movable between an applied position and a released position;

wherein the brake member is configured to apply a force to the link when the brake member is in the applied position which dampens movement of the door to at least one of the open position and the closed position, and the brake member is configured to release the link when the brake member is in the released position to allow unrestricted movement of the door to at least one of the open position and the closed position;

wherein the braking apparatus includes a housing and a sleeve that surround the link; and wherein the braking apparatus includes an actuator operatively coupled to the sleeve to move the sleeve independently of the housing.

11. The vehicle as set forth in claim 10:

wherein the housing defines an aperture along a central axis, with the link disposed through the aperture, and the housing is movable relative to the link during movement of the link between the first and second positions;

wherein the link includes a first link end fixed to the body such that the first link end defines a pivot point that the link rotates about when moving between the first and second positions, and the link includes a second link end spaced from the first link end relative to the central axis;

further including a bracket fixed to the door and coupled to the braking apparatus to support the braking apparatus relative to the link;

wherein the actuator is fixed to the door and operable to move the sleeve which causes the brake member to move to at least one of the applied position and the released position;

wherein the housing is disposed closer to the first link end than the second link end when the door is in the closed position; and wherein the housing is disposed closer to the second link end than the first link end when the door is in the open position.

12. The vehicle as set forth in claim 10 wherein:

the housing defines an aperture along a central axis, with the link disposed through the aperture;

the brake member is further defined as a first brake member and the braking apparatus includes a second brake member, with the link disposed between the first and second brake members;

the link includes a first outer surface and a second outer surface opposing each other;

the first brake member contacts the first outer surface when in the applied position and the second brake member contacts the second outer surface when in the applied position;

the link includes a first link end fixed to the body such that the first link end defines a pivot point that the link rotates about when moving between the first and second positions, and a second link end spaced from the first link end relative to the central axis, with the housing and the first and second brake members disposed between the first and second link ends; and the actuator is operable to move the sleeve which causes the first and second brake members to move to at least one of the applied position and the released position.

13. The vehicle as set forth in claim 10 wherein:

the sleeve includes an inner wall and the brake member includes an outer wall;

the inner wall of the sleeve and the outer wall of the brake member engage each other; and at least one of the inner wall and the outer wall include a tapered surface extending axially relative to a central axis.

14. A check link assembly comprising:

a link movable between a first position and a second position;

a braking apparatus coupled to the link, and the braking apparatus includes a brake member movable between an applied position and a released position;

wherein:

the brake member is configured to apply a force to the link when the brake member is in the applied position which hinders movement of the braking apparatus relative to the link, and the brake member is configured to release the link when the brake member in the released position;

the braking apparatus includes a sleeve that surrounds the link and a housing that contains the sleeve;

the housing defines an aperture along a central axis, with the link disposed through the aperture;

the brake member is further defined as a first brake member and the braking apparatus includes a second brake member, with the link disposed between the first and second brake members;

the link includes a first outer surface and a second outer surface opposing each other;

the first brake member contacts the first outer surface when in the applied position and the second brake member contacts the second outer surface when in the applied position;

the link includes a first link end and a second link end spaced from each other relative to the central axis, with the housing and the first and second brake members disposed between the first and second link ends; and the braking apparatus includes an actuator operable to cause the first and second brake members to move to at least one of the applied position and the released position.

15. The assembly as set forth in claim 14 wherein:

the sleeve includes an inner wall and the first and second brake members each include an outer wall;

the outer wall of the first and second brake members engage the inner wall of the sleeve; and at least one of the inner wall and the outer wall include a tapered surface extending axially relative to the central axis.

16. The assembly as set forth in claim 14 wherein the first and second brake members and the sleeve are disposed in the aperture of the housing.

17. The assembly as set forth in claim 14 wherein the sleeve defines a hole along a central axis, with the link disposed through the hole, and wherein the sleeve is movable axial relative to the central axis between an initial position and a final position, and wherein movement of the sleeve to one of the initial position and the final position causes the first and second brake members to move to one of the applied position and the released position.

18. The assembly as set forth in claim 14 wherein the actuator is operable to move the sleeve axially relative to the central axis between an initial position and a final position.

19. The assembly as set forth in claim 18 wherein the braking apparatus includes a first biasing member that returns the sleeve to the other one of the initial position and the final position.

20. The assembly as set forth in claim 19 wherein the braking apparatus includes a stop engaging an end of the first and second brake members to minimize axial movement of the first and second brake members relative to the central axis independently of the sleeve and a second biasing member engaging a portion of the first and second brake members to return the first and second brake members to one of the applied position and the released position.

* * * * *